US005100121A

United States Patent [19]

Takei et al.

[11] Patent Number: 5,100,121

[45] Date of Patent: Mar. 31, 1992

[54] SHEET FEEDER FOR AN IMAGE FORMING APPARATUS

[75] Inventors: Hajime Takei, Machida; Sadanobu Murasaki, Isehara; Naoyuki Matsuda, Machida; Yukiyoshi Yamakoshi, Isahara; Homare Sano, Machida, all of Japan

[73] Assignee: Minolta Camera Kabushiki Kaisha, Osaka, Japan

[21] Appl. No.: 634,612

[22] Filed: Dec. 27, 1990

[30] Foreign Application Priority Data

Dec. 28, 1989 [JP] Japan ..... 1-341294

[51] Int. Cl.[5] ..... B65H 3/34

[52] U.S. Cl. ..... 271/104; 271/20

[58] Field of Search ..... 271/11, 20, 103–107

[56] References Cited

U.S. PATENT DOCUMENTS 2,185,652 1/1940 Spiess ..... 271/106
4,921,237 5/1990 Nubson et al. ..... 271/104

FOREIGN PATENT DOCUMENTS 5331740 8/1979 Japan .
0115871 9/1979 Japan ..... 271/106
1211058 4/1983 Japan .
144504 12/1989 Japan .

*Primary Examiner*—H. Grant Skaggs
*Attorney, Agent, or Firm*—Price, Gess & Ubell

[57] ABSTRACT

Disclosed is a sheet feeder comprising a magazine in which sheets are stacked, a sucker for sucking a sheet stacked in the magazine, a stepping motor for raising the sucker, and a sheet separation click which is so disposed that an edge of the sheet sucked by the sucker comes into contact with the click when the sucker is raised to a specified position. The sucker is raised at a small pitch when the edge of the sucked sheet comes into contact with the sheet separation click, whereby sheets which have been adhering to the sucked topmost sheet separate therefrom and fall.

11 Claims, 7 Drawing Sheets

SHEET FEEDER FOR AN IMAGE FORMING APPARATUS

BACKGROUND OF THE INVENTION

1. Field of the Invention

The present invention relates to a sheet feeder, and more particularly to a sheet feeder for feeding photosensitive films, sheets coated with resin or the like stacked in a magazine one by one.

2. Description of Related Art

A vacuum sucking type sheet feeder has been provided in various apparatus in order to feed stacked sheets one by one without causing damage to surfaces of the sheets. In this type sheet feeder, a sucker is apt to pick up more than one sheet at a time because the sheets succeeding the topmost sheet adhere thereto by electrostatic force. Especially when resin films are to be fed, such trouble often occurs. Therefore it is required to separate sheets caught by the sucker in order to feed a single sheet at a time certainly.

Japanese Patent Laid Open Publication No. 1-21058 discloses a sheet separating method using a click. In the method, sheets caught by the sucker is merely touched by the click on the corners immediately before the sheets are fed out of a magazine, and therefore the method is not effective on soft and flexible sheets.

SUMMARY OF THE INVENTION

It is therefore an object of the present invention to provide a sheet feeder wherein sheets caught by a sucker are certainly separated in a simple way.

In order to attain the object, a sheet feeder according to the present invention comprises a click which is so disposed that an edge of a sheet sucked up by a sucker comes into contact with the click, and control means for raising the sucker at a small pitch when the edge of the sucked sheet comes into contact with the click.

In the structure, when a sheet sucked by the sucker contacts with the click, the sheet slightly bends. In this state, the sucker is raised at a small pitch. Thereby, the sucker and the sheet vibrate, and sheets which have been adhering to the sucked topmost sheet separate therefrom and fall.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE PREFERRED EMBODIMENTS

An exemplary sheet feeder embodying the principles and features of the present invention is hereinafter described in reference to the accompanying drawings.

Figure 1:
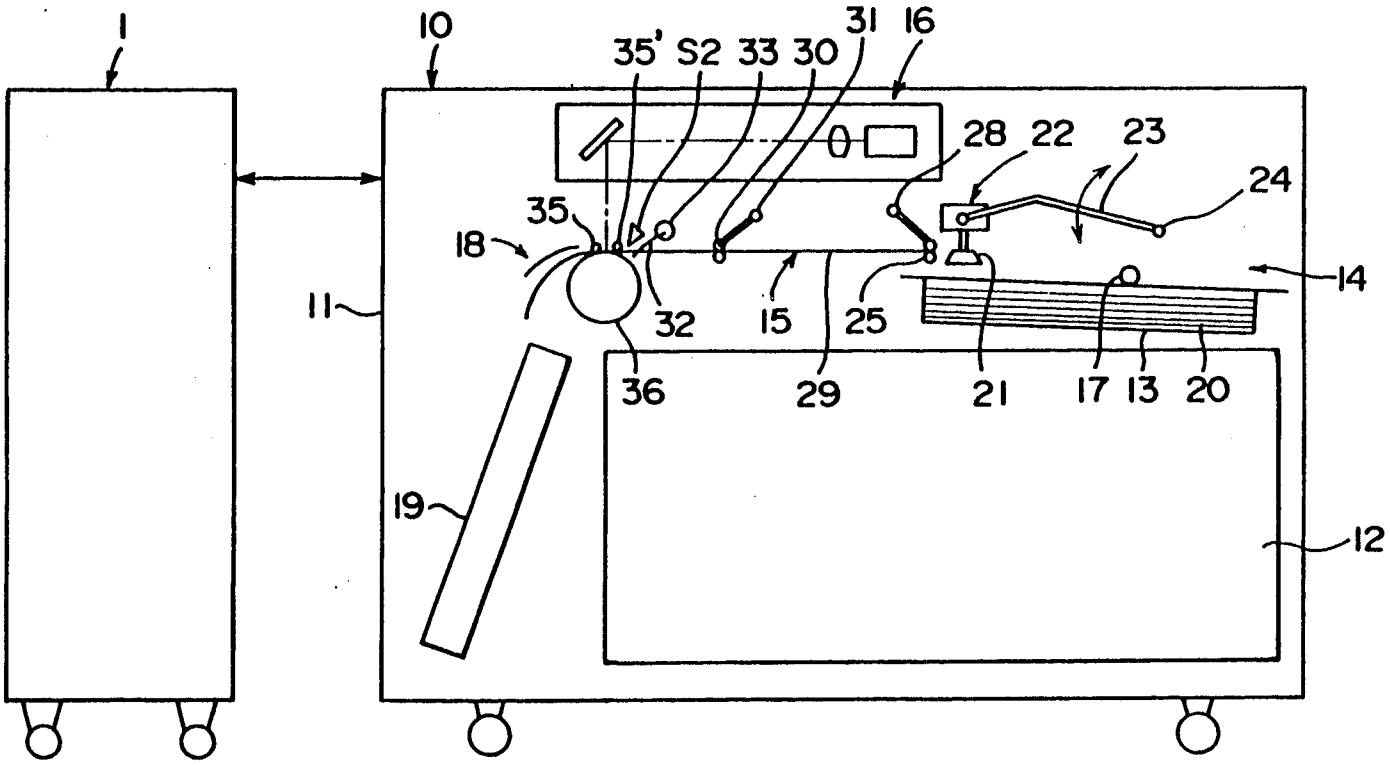
FIG. 1 is a schematic view of a printer provided with a film feeder which is an embodiment of the present invention.

FIG. 1 shows the general structure of a printer provided with a sheet feeder according to the present invention. The printer 10 has a box-type housing 11, and in the housing 11 are provided a power supply box 12, a film magazine 13, a film feeder 14, a film transport unit 15, an optical unit 16, a sub-scan unit 18 and a receive magazine 19. The interior of the housing 11 is shielded from light.

The magazine 13, in which unexposed films 20 are stacked, is disposed above the power supply box 12, and a light screening cover 41 is provided so as to cover and uncover the films 20 automatically.

Above the magazine 13 is disposed a vacuum type film feeder 14 for feeding the films 20 out of the magazine 13 one by one. In the film feeder 14, a sucker holder 22 holding vacuum suckers 21 is fixed on arms 23 at the end. The arms 23 are capable of pivoting on shafts 24 in the directions shown by the arrow in a manner to enable the vacuum suckers 21 to he kept in the horizontal posture, so that the vacuum suckers 21 suck the topmost film of the film stack 20 to feed it between transport rollers 25 disposed at the entrance of the film transport unit 15.

The transport rollers 25 of the film transport unit 15 are composed of a lower roller which is a driving roller and an upper roller which is a driven roller, and the upper roller is capable of pivoting on a shaft 28 so that the rollers 25 come into contact with each other and separate from each other. While the rollers 25 are separate from each other, the leading edge of a film picked up by the film feeder 14 is inserted between the rollers 25, successively the upper roller comes into contact with the lower roller to pinch the film, and then the film is transported onto a guide plate 29. In the center of the transport unit 15 are disposed diskew rollers 30 which are composed of an upper roller and a lower roller. The upper roller, which is a driving roller, is capable of pivoting on a shaft 31. The diskew rollers 30 are provided in order to correct the skew of the film transported by the rollers 25. The leading edge of the film contacts with a stopper 32, which is capable of pivoting on a shaft 33, and comes to a stop regulated by the stopper 32.

Next, the film is released from the regulation by the stopper 32 and comes into the sub-scan unit 18 comprising upper rollers 35 and 35' which are freely rotatable and coated with elastic material, and a sub-scan drum 36 which is a driven drum. While the film is moving in the sub-scan unit 18, it is exposed to a laser beam which is radiated from the optical unit 16 in the direction along the axis of the subscan drum 36. The thus exposed film is received by the magazine 19. The receive magazine 19 in which exposed films are stored is discharged from the printer 10 shielding the films from light, and thereafter the films are developed. Further, instead of the receive magazine 19, a developing device may be installed inside the printer 10 so that each film is developed inside the printer 10 as soon as it has been exposed. In this case, the developed films are ejected from the printer 10 one after another.

Incidentally, a host machine 1 is placed next to the printer 10, and image data are transmitted from the host machine 1 to the printer 10 for one image at a time.

Figure 2:
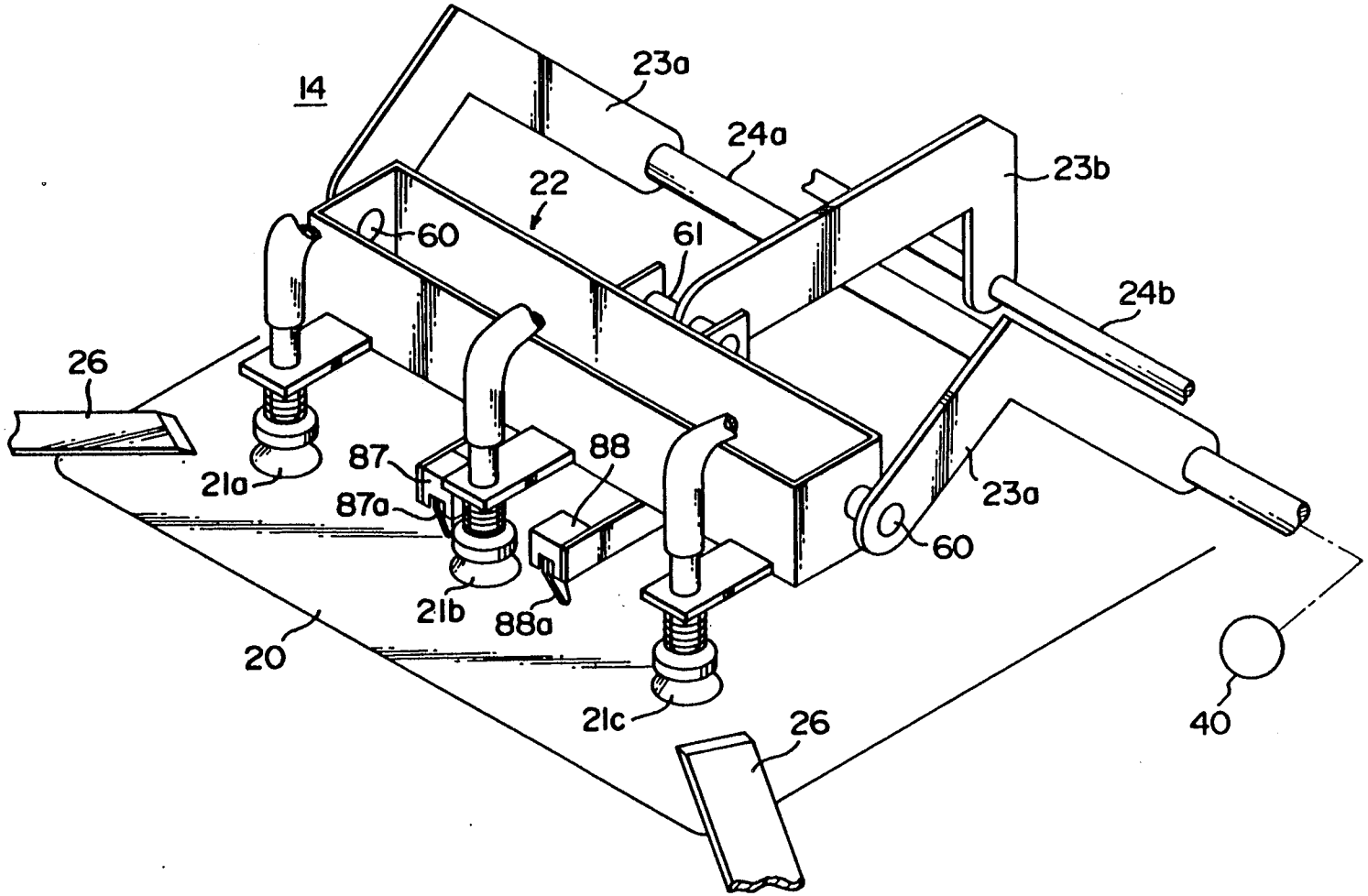
FIG. 2 is a perspective view of the film feeder.
Figure 3:
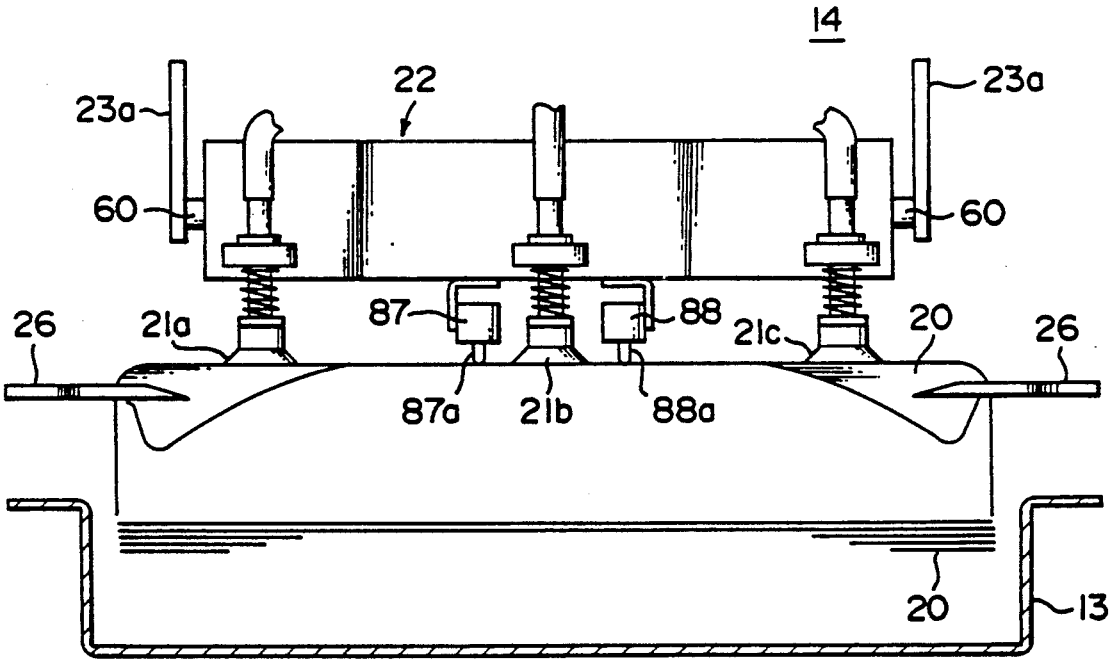
FIG. 3 is a plan view of the film feeder.
Figure 4:
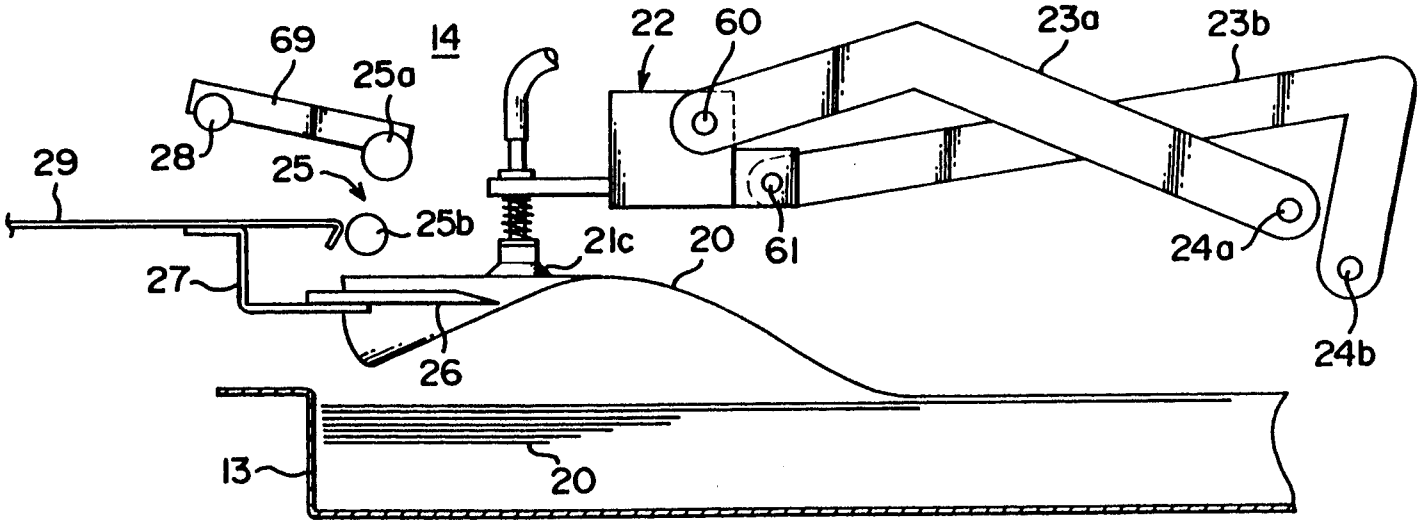
FIG. 4 is a side view of the film feeder.

Referring to FIGS. 2, 3 and 4, the structure of the film feeder 14 for feeding a film from the magazine 13 to the film transport unit 15 is hereinafter described.

The film feeder 14 has three vacuum suckers 21*a*, 21*b* and 21*c* which are supported by a sucker holder 22 and arranged in a line perpendicular to the direction of the film feed. The suckers 21*a*, 21*b* and 21*c* are connected with a vacuum device (not shown) via tubes. The sucker holder 22 is supported by arms 23*a* and 23*b* via pins 60 and 61. The arms 23*a* are fitted on a shaft 24*a*, and the arm 23*b* is fitted on a shaft 24*b*. The shaft 24*a* is driven by a sucker holder motor 40 to rotate, which rotation moves the arms 23*a*, and thereby the sucker holder 22 is moved up and down. The sucker holder motor 40 is a stepping motor which can be rotated forward and in reverse by pulses.

As shown in FIG. 4, the transport rollers 25 are disposed opposite a film feeding position of the sucker holder 22 and are composed of an upper roller 25*a* and a lower roller 25*b*. The lower roller 25*b* is driven to rotate by a transport motor (nor shown). The upper roller 25*a* is capable of pivoting up and down on the shaft 28 together with its holder 69. The holder 69 is provided with a sensor (not shown) to judge whether a film is nipped between the rollers 25. Further, a sensor (not shown) which detects one of the arms 23*a* is fixed on the frame (not shown) of the printer 10 to judge whether the sucker holder 22 is at the highest position.

Immediately below the transport rollers 25, a pair of separation clicks 26 is provided on the edge of the guide plate 29 via a bracket 27 and is extended toward the film feeder 14. The right and left corners on the leading edge of a film caught by the suckers 21*a*, 21*b* and 21*c* comes into contact with the clicks 26 from below immediately before the sucker holder 22 reaches the film feed position. Thereby, the film bends downward on the corners (see FIGS. 3 and 4). At that time, the suckers 21*a*, 21*b* and 21*c* are stopped from moving up, and the sucker holder motor 40 is turned on and off intermittently. Thereby, the film caught by the suckers 21*a*, 21*b* and 21*c* vibrates with the corners contacting with the clicks 26. Even if the suckers 21*a*, 21*b* and 21*c* catch more than one film at that time, films other than the topmost film will fall down to the magazine 13 because of the vibration. In addition, a sensor for detecting one of the arms 23*a* is provided to judge whether the sucker holder 22 reaches a position for the sheet separation.

After separating sheets, the suckers 21*a*, 21*b* and 21*c* start moving up again. While the upper transport roller 25*a* upwardly recedes from the lower roller 25*b*, the leading edge of the film is placed on the lower roller 25*b*. Then, the upper roller 25*a* comes down, and the film is nipped between the rollers 25*a* and 25*b*. Thereafter, the lower roller 25*b* is driven to rotate in order to transport the film onto the guide plate 29 in the film transport unit 15.

Sensors 87 and 88 are disposed at either side of the sucker 21*b* to detect films in the magazine 13, to detect a film caught by the suckers 21*a*, 21*b* and 21*c*, and to detect the sucker holder 22 at the lowest position. The sensors 87 and 88 have downward extending actuators 87*a* and 88*a* respectively, and a concavity is formed on the magazine 13 at a position opposite the actuator 87*a*. When the suckers 21*a*, 21*b* and 21*c* move down, arrival of the sucker holder 22 at the lowest position is judged from a turning-on of the sensor 88 by contact of the actuator 88*a* with either the topmost film in the magazine 13 or the bottom plate of the magazine 13. If the actuator 87*a* comes into the concavity at that time, the sensor 87 is kept off, and emptiness of the magazine 13 is judged. The suction of a film by the suckers 21*a*, 21*b* and 21*c* is judged from a turning-on of the sensor 88.

Figure 5:
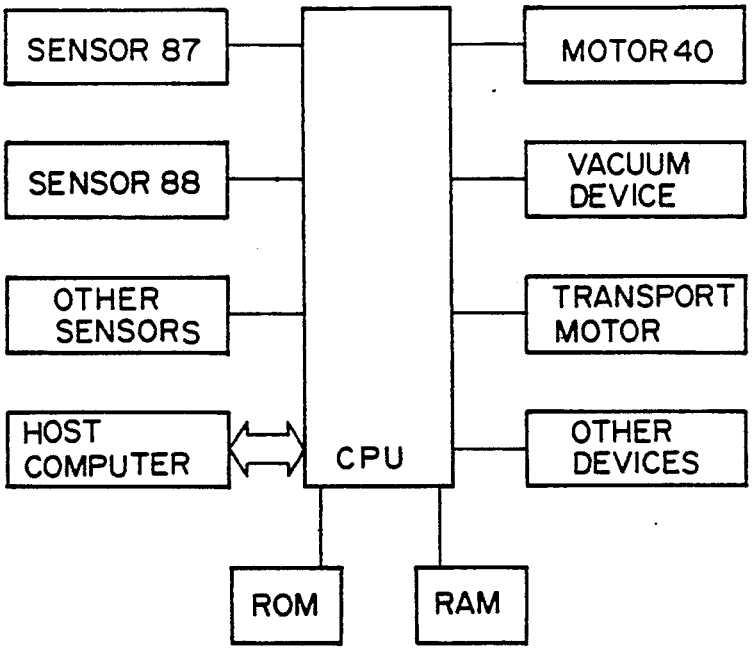
FIG. 5 is a block diagram showing a control circuitry.

FIG. 5 shows a control circuitry for the printer 10. The center of this control circuitry is a central processing unit (CPU) incorporating a read only memory (ROM) and a random access memory (RAM) therein. The CPU communicates with the host computer. Signals from the sensors 87 and 88, etc. are transmitted to the CPU, and signals are sent from the CPU to the sucker holder motor 40' the vacuum device transport motor, etc.

Figure 6A:
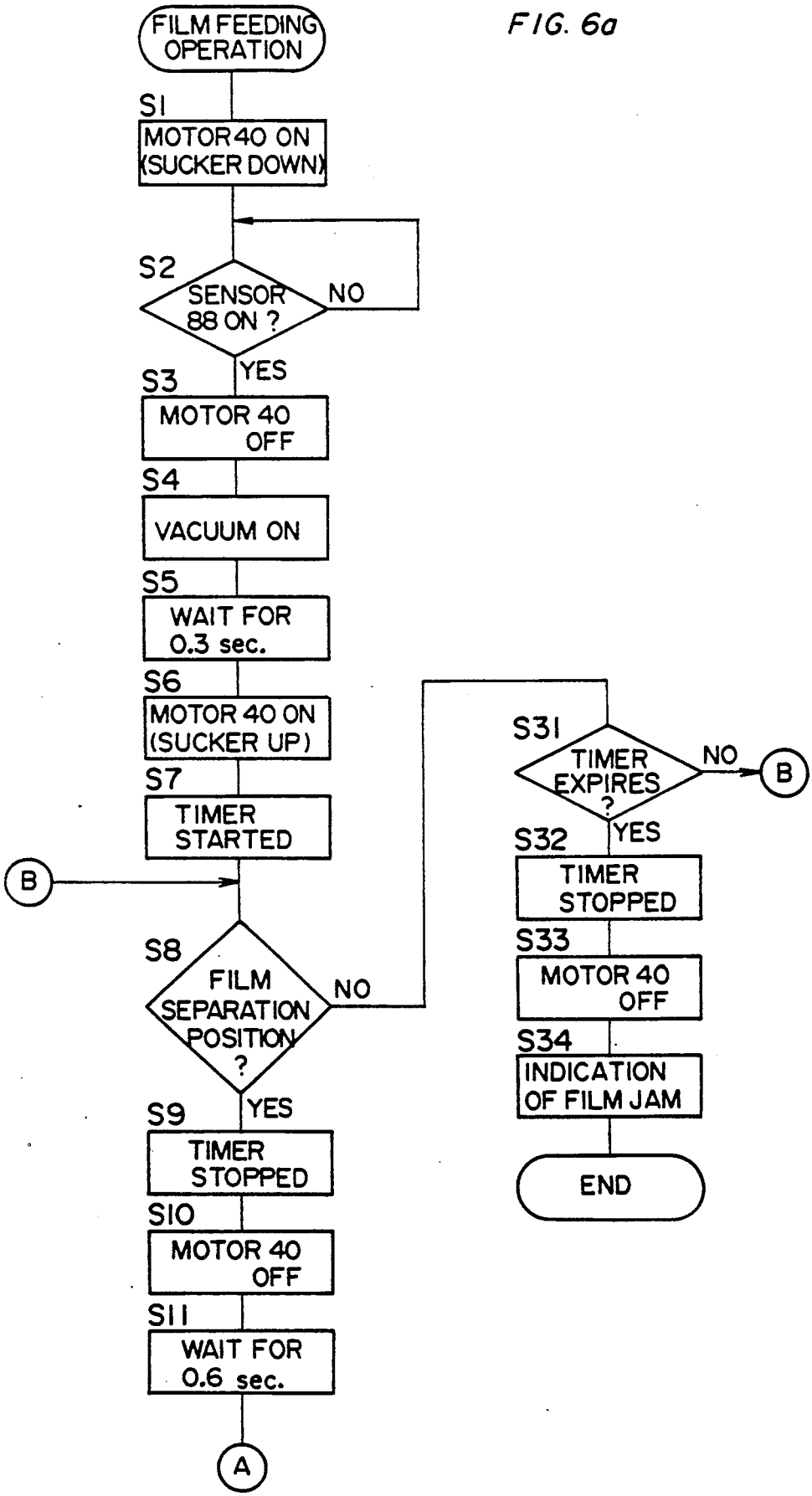
FIGS. 6*a* and 6*b* are flowcharts showing a procedure of feeding a film.
Figure 6B:
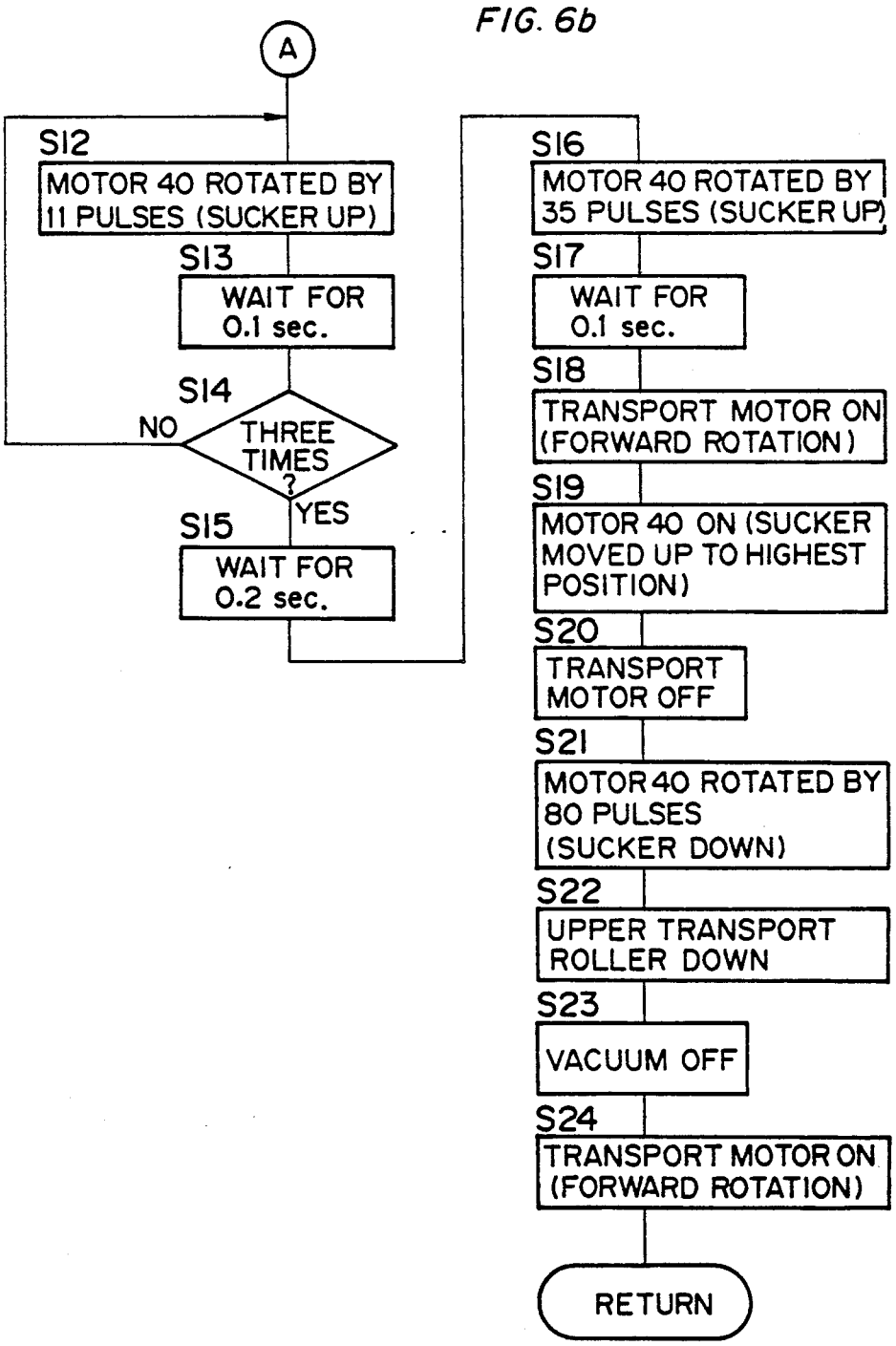

Now referring to FIGS. 6*a* and 6*b*, a procedure of feeding a film by the film feeder 14 is hereinafter described.

First, the sucker holder motor 40 is turned on at step S1 to move down the sucker holder 22. When it is judged from a turning-on of the sensor 88 that the suckers 21*a*, 21*b* and 21*c* reaches the uppermost sheet in the magazine 13 ("YES" at step S2), the sucker holder motor 40 is turned off at step S3. Successively, the vacuum device is turned on at step S4, and the condition is maintained for three seconds at step S5. Thereby, the suckers 21*a*, 21*b* and 21*c* suck the uppermost film in the magazine 13.

Next, the sucker holder motor 40 is turned on at step S6 to move up the sucker holder 22, and a timer is started at step S7 When the sucker holder 22 comes to the film separation position where the clicks 26 touch the film caught by the suckers 21*a*, 21*b* and 21*c* on the corners ("YES" at step S8), the timer is stopped at step S9 and the sucker holder motor 40 is turned off at step S10. Then, the condition is maintained for 0.6 seconds at step S11.

When the sucker holder 22 does not come up to the film separation position before the timer expires ("NO" at step S8 and "YES" at step S31), the occurrence of a film jam is judged. Accordingly, the timer is stopped at step S32, and the sucker holder motor 40 is turned off at step S33. Then, the occurrence of a film jam is indicated at step S34

As mentioned, when the sucker holder 22 is moved up normally, the sucker holder 22 is maintained at the film separation position for 0.6 seconds. Thereafter the sucker holder motor 40 is rotated by 11 pulses at step S12 to move up the sucker holder 22, and at step S13, the sucker holder 22 is maintained at a position to which the sucker holder 22 is brought by the 11-pulse rotation of the motor 40. The processes at step S12 and S13 are repeated three times That is, the suckers 21*a*, 21*b* and 21*c* are moved upward little by little in a state that the film caught by the suckers 21*a*, 21*b* and 21*c* contacts with the clicks 26. Thereby, the film vibrates, and if more than one film is caught by the suckers 21*a*, 21*b* and 21*c*, the films other than the topmost film will fall down.

After upward movements of the sucker holder 22 by three 11-pulse rotations of the motor 40, at step S15 the sucker holder 22 is stationary for 0.2 seconds. Then, the sucker holder motor 40 is rotated by 35 pulses at step S16 to move up the sucker holder 22, and thereafter at step S17 the sucker holder 22 is kept stationary for 0.1 second. Thus, a single film which survived the film separation comes over the clicks 26.

Next, the transport motor is turned on at step S18 to rotate the lower transport roller 25*b* forward. Simultaneously, the sucker holder motor 40 is turned on at step S19 to move up the sucker holder 22. When the sucker holder 22 reaches the highest position at step S19, the transport motor is turned off at step S20. Thus, the leading edge of the film comes over the lower transport roller 25*b* and is placed between the transport rollers 25*a* and 25*b* while the upper roller 25*a* recedes from the lower roller 25*b*.

Then, the sucker holder motor 40 is rotated by 80 pulses at step S21 to move down the sucker holder 22 to the film feed position. Simultaneously, the upper transport roller 25*a* is moved down at step S22 so that the leading edge of the film is nipped between the rollers 25*a* and 25*b*. The vacuum device is turned off at step S23 to release the film from the suction of the suckers 21*a*, 21*b* and 21*c*. Then, the transport motor is rotated forward at step S24. Thereby, the film is transported through the transport unit 15 to the sub-scan unit 18 where the film receives an image in accordance with data transmitted from the host machine 1.

Although the present invention has been described in connection with the embodiment above, it is to be noted that various changes and modifications are apparent to those who are skilled in the art. Such changes and modifications are to be understood as included within the scope of the present invention defined by the appended claims, unless being separated therefrom.

For example, subjects to be fed by the sheet feeder may be copy sheets, sheets coated with resin, etc. as well as photosensitive films.

The process of slightly moving up the suckers 21*a*, 21*b* and 21*c* in order to separate films caught by the suckers 21*a*, 21*b* and 21*c* may be repeated any number of times. Also, it is possible to repeat an upward and downward movement of the suckers 21*a*, 21*b* and 21*c* for the film separation as well as an upward movement.

What is claimed is:

1. A sheet feeder comprising:

storing means for storing stacked sheets therein;

sucking means for sucking a sheet out of the storing means;

separating means which is so disposed that an edge of the sheet sucked by the sucking means comes into contact with the separating means; and raising means for intermittently raising the sucking means when the edge of the sheet comes into contact with the separating means.

2. A sheet feeder as claimed in claim 1, wherein the sucking means has a plurality of suckers.

3. A sheet feeder as claimed in claim 1, wherein the raising means has a stepping motor.

4. A sheet feeder as claimed in claim 3, wherein the stepping motor rotates in accordance with a predetermined number of pulse signals by a predetermined time period in order to raise the sucking means at a small pitch.

5. A sheet feeder as claimed in claim 1, wherein the sheet separating means comprises two clicks.

6. A sheet feeder as claimed in claim 5, wherein the clicks are so disposed that corners of the sheet sucked by the sucking means come into contact with the clicks.

7. A sheet feeder comprising:

storing means for storing stacked sheets therein;

a sucker for sucking a sheet in the storing means;

raising means for raising the sucker;

separating means which is so disposed that an edge of the sheet sucked by the sucker comes into contact with the separating means when the sucker is raised to a specified position; and control means for controlling the raising means to raise the sucker with an intermittent movement having a series of stationary positions when the edge of the sheet comes into contact with the separating means.

8. A sheet feeder as claimed in claim 7, wherein the raising means has a stepping motor.

9. A sheet feeder as claimed in claim 8, wherein the control means applies a predetermined number of pulse signals to the stepping motor by a predetermined time period in order to raise the sucker at a small pitch.

10. An improved sheet feeder assembly comprising:

means for receiving a stack of sheets;

a holder member mounted for relative movement to the stack of sheets;

means for applying a suction force to the stack of sheets to secure an uppermost sheet in the stack with the suction force, including a sucker member for contact with the uppermost sheet and operatively connected to the holder member;

separating means for mechanically contacting the sheet attached by the suction force of the sucker member to assist in separating any lower sheets that may be inadvertently attached to the uppermost sheet, and control means for moving the holder member and applying suction to the sucker member, the control means positioning the holder member to, first, apply suction to the uppermost sheet in the stack with the sucker member, second, move the holder member with the sucker member attached by suction to the uppermost sheet away from the stack of sheets to a predetermined position in contact with the separating means, third, hold the holder member at a fixed position with the uppermost sheet in contact with the separating member for a predetermined period of time and fourth, continue the movement of the sucker member away from the stack of sheets whereby any inadvertently attached sheets are released.

11. The sheet feeder of claim 10 wherein the control means repetitively repeats its third and fourth functions to vibrate the uppermost sheet for releasing any inadvertently attached sheets.

* * * * *